US008360136B2

(12) United States Patent
Matsui et al.

(10) Patent No.: US 8,360,136 B2
(45) Date of Patent: Jan. 29, 2013

(54) CONTINUOUS CASTING METHOD AND NOZZLE HEATING DEVICE

(75) Inventors: Taijiro Matsui, Tokyo (JP); Shinichi Fukunaga, Tokyo (JP); Hiroshi Imawaka, Tokyo (JP); Kohichiroh Kataoka, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/141,662

(22) PCT Filed: Dec. 28, 2009

(86) PCT No.: PCT/JP2009/007362

§ 371 (c)(1),
(2), (4) Date: Jun. 22, 2001

(87) PCT Pub. No.: WO2010/073736

PCT Pub. Date: Jul. 1, 2010

(65) Prior Publication Data

US 2011/0253337 A1 Oct. 20, 2011

(30) Foreign Application Priority Data

Dec. 26, 2008 (JP) ..... P2008-332935

(51) Int. Cl.
*B22D 11/10* (2006.01)

(52) U.S. Cl. ..... 164/488; 164/437

(58) Field of Classification Search ..... 164/437–439, 164/488–490, 121

See application file for complete search history.

(56) References Cited

U.S. PATENT DOCUMENTS

| | | | | | |
|---|---|---|---|---|---|
| 3,604,598 | A | * | 9/1971 | Kappmeyer et al. | 222/146.5 |
| 4,265,682 | A | * | 5/1981 | Tsuya et al. | 148/112 |
| 4,339,508 | A | * | 7/1982 | Tsuya et al. | 428/606 |
| 6,043,468 | A | * | 3/2000 | Toya et al. | 219/544 |

FOREIGN PATENT DOCUMENTS

| | | | | |
|---|---|---|---|---|
| CA | 2 149 422 | C | | 3/1995 |
| CA | 2 651 258 | A1 | | 1/2003 |
| CN | 101157557 | A | | 4/2008 |
| JP | 49-138116 | A | | 11/1974 |
| JP | 49-138116 | U | | 11/1974 |
| JP | 1-170561 | A | | 7/1989 |
| JP | 1-219027 | | * | 9/1989 |
| JP | 6-552 | U | | 1/1994 |
| JP | 10-118746 | | * | 5/1998 |
| JP | 2000-21890 | A | | 1/2000 |
| JP | 2001-332373 | A | | 11/2001 |

(Continued)

OTHER PUBLICATIONS

Inada et al., "Application of Carbon-free High-Alumina Refractory to Continuous Casting Immersion Nozzle", CAMP-ISIJ, vol. 9, (1996), p. 196.

(Continued)

*Primary Examiner* — Kuang Lin
(74) *Attorney, Agent, or Firm* — Birch, Stewart, Kolasch & Birch LLP

(57) ABSTRACT

In a continuous casting method, the outside surface of a continuous casting nozzle which supplies molten metal into a mold while immersed in the molten metal in the mold, is heated to 1000° C. or higher by a nozzle heating device comprising an external heater which performs radiant heating, while the molten metal passes through the continuous casting nozzle.

5 Claims, 6 Drawing Sheets

FOREIGN PATENT DOCUMENTS

| | | | |
|---|---|---|---|
| JP | 2002-336942 | A | 11/2002 |
| JP | 2004-243407 | A | 9/2004 |
| JP | 2006-297476 | A | 11/2006 |
| JP | 2008-55472 | A | 3/2008 |
| JP | 2009-233729 | A | 10/2009 |

OTHER PUBLICATIONS

International Search Report, PCT/JP2009/007362, Mar. 9, 2010.
Kasai et al., "Explanation of clogging phenomena of CC nozzle", Refractory Materials, vol. 42, (1990), pp. 14-25.
Kasai et al., "Explanation of clogging phenomena immersion of CC immersion nozzle", Refractory Materials, vol. 42, (1990), pp. 14-25.
Canadian Office Action dated Sep. 28, 2012 issued in Canadian Patent Application No. 2,748,179.
Chinese Office Action mailed Sep. 19, 2012 for Chinese Patent Application No. 200980152024.6 (English translation is attached).
Korean Office Action dated Oct. 23, 2012 for Korean Patent Application No. 10-2011-7014387 (English translation is attached).

* cited by examiner

CONTINUOUS CASTING METHOD AND NOZZLE HEATING DEVICE

TECHNICAL FIELD

The present invention relates to a continuous casting method, and to a nozzle heating device which heats a continuous casting nozzle which supplies molten metal into a mold when performing this continuous casting method.

Priority is claimed on Japanese Patent Application No. 2008-332935, filed Dec. 26, 2008, the contents of which are incorporated herein by reference.

BACKGROUND ART

In the continuous casting of steel, in order to increase productivity, the flow of the continuous casting process must be performed continuously with as few interruptions as possible (that is, with a greater number of consecutive charges). Because most of the steel produced by continuous casting is aluminum-killed steel, a molten steel thereof contains a large amount of alumina produced by deoxidation, or reoxidation due to air or slag.

Consequently, when the casting time is lengthened by increasing the number of consecutive charges, adhesion of above-mentioned alumina and base metal tend to accumulate on the refractory pouring nozzle and cause nozzle blockages, which is one impediment in terms of increasing the number of continuous charges. As a countermeasure, conventionally, a method in which argon gas is blown into the molten steel inside the nozzle to achieve a cleaning effect, thereby preventing alumina buildup to the submerged nozzle has been widely used.

Furthermore, to prevent a reaction or adhesion occurring between the refractory materials and the molten steel or alumina or the like, the composition of the refractory materials of the nozzle has also been examined, leading to the development of a variety of adhesion resistant materials.

For example, Non-Patent Document 1 reports the results of investigating the alumina adhesion reducing effect achieved by applying a carbonless high-alumina refractory material to the submerged nozzle.

Furthermore, Non-Patent Document 2 reports that producing a low melting point compound in the $ZrO_2$—C—CaO—$SiO_2$ system is effective for preventing alumina adhesion.

On the other hand, to prevent the adhesion and solidification of base metal on the inside wall of the nozzle, keeping the nozzle at a high temperature has proved effective. Therefore, in the course of normal operation, the nozzle is sufficiently preheated by a gas burner or the like before beginning the casting process. Furthermore, a technique is known in which the nozzle is kept at a predetermined temperature by heating the nozzle during the casting process, thereby preventing the adhesion of base metal. Specific examples of this heating method include a method in which the nozzle itself generates heat, and a method in which heat is applied externally to the nozzle.

For example, as the above-mentioned method in which the nozzle itself generates heat, a technique is proposed in which a heating element is embedded inside the nozzle body, and the nozzle is heated by energizing the heating element (for example, refer to Patent Document 1).

Furthermore, a technique is proposed in which induction heating is performed using a nozzle in whose nozzle body is embedded a conductive refractory material with electrical resistivity of $10^2$ Ω·cm (for example, refer to Patent Document 2).

On the other hand, as a method of heating the nozzle by supplying heat externally, a technique is proposed in which a block heater made of steel is disposed around the periphery of the nozzle (for example, refer to Patent Document 3). In this method, by using the block heater in combination with a sheath heater, the surface temperature of the nozzle can be raised to 850° C. or thereabouts.

Furthermore, as a high temperature heater, a carbon heater (carbon wire heating element) enclosed in a silica glass member is proposed (for example, refer to Patent Document 4). Moreover, as a preheating technique before casting begins, IH (induction heating) preheating can be used as an alternative to the typical gas burner preheating (for example, refer to Patent Document 5 and Patent Document 6). Because gas burner preheating requires time to preheat the nozzle, approximately 1.5 to 2 hours is needed from the start of preheating to the finish. On the other hand, because IH preheating has excellent heating efficiency, only 40 minutes or thereabouts is needed.

Generally, preheating of the nozzle is performed to prevent spalling due to thermal shock caused by the molten metal at the initial stage of casting, and to prevent the nozzle from becoming blocked when the molten metal loses sensible heat to the nozzle during casting, causing the formation of a solid layer of molten steel on the inside wall of the nozzle. In gas burner preheating, to improve preheating efficiency, and suppress a reduction in nozzle temperature in the interval after preheating before the nozzle is attached to the tundish, in recent years, the outer surface of the nozzle is sometimes covered by an insulating material.

PRIOR ART DOCUMENTS

Patent Documents

[Patent Document 1] Japanese Unexamined Utility Model Application, First Publication No. H 6-552

[Patent Document 2] Japanese Unexamined Patent Application, First Publication No. 2002-336942

[Patent Document 3] Japanese Unexamined Patent Application, First Publication No. 2004-243407

[Patent Document 4] Japanese Unexamined Patent Application, First Publication No. 2001-332373

[Patent Document 5] Japanese Unexamined Patent Application, First Publication No. 2008-055472

[Patent Document 6] Japanese Unexamined Patent Application, First Publication No. 2009-233729

Non-Patent Documents

[Non-Patent Document 1] Materials and Processes Vol. 9 (1996) p. 196

[Non-Patent Document 2] Refractory Materials, Vol. 42 (1990) p. 14

Problems to be Solved by the Invention

However, in the method of blowing argon gas into the molten steel in the nozzle, although some degree of preventative effect is acknowledged, the adhesion of alumina and base metal and the like cannot be completely prevented. To further maximize the number of consecutive charges, nozzle blockages due to alumina and base metal and the like must be more reliably prevented.

Furthermore, in this method, bubbles of the blown-in argon gas enter the mold together with the molten steel, and when these bubbles rise to the top of the mold and exit the surface of the molten steel bath, the mold powder coating the top of the molten steel bath surface mixes into the molten steel, and becomes trapped in the solid shell that solidifies inside the mold. As a result, it is possible to have a defective product.

In addition, the pores formed in the solidifying shell by the trapped argon gas bubbles can sometimes lead to a defective product. Moreover, the argon gas bubbles in the molten steel are present in a variety of sizes, with each individual bubble having different momentum. Therefore, the presence of such argon gas bubbles can render the flow of molten steel unstable, and is considered to be a cause of drift flow and the like inside the mold. Consequently, it is desired that the blowing of argon gas which can cause defects is reduced in the prevention of nozzle blockages.

Furthermore, in the method of changing the composition of the submerged nozzle as described in Non-Patent Document 1 and Non-Patent Document 2, although an alumina adhesion reducing effect is achieved to a certain degree, because a temperature difference exists between the inside surface of the submerged nozzle and the molten steel, alumina adhesion cannot be prevented completely. Accordingly, although the number of consecutive charges can be somewhat increased, nozzle blockages cannot be prevented completely. Moreover, if the inside surface has a significantly lower solidification point than that of the type of steel being cast, because adhesion of a thin coat of base metal occurs extremely quickly, the characteristics of the refractory materials cannot be fully utilized, and blockage prevention is not achieved.

On the other hand, when the nozzle is to be heated during casting, in the method of embedding an energized heating element inside the nozzle as shown in Patent Document 1 and Patent Document 2, in relation to integrally forming the nozzle body with the energized heating element, problems occur in the form of breakages, oxidative degradation of the connectors of the electrode terminals, and electrical leakage during energization. Furthermore, aspects such as the specific method of energizing the nozzle present difficulties from an engineering perspective, and are not necessarily practical.

In addition, in the case of application to actual operations, the target temperature must be reached as quickly as possible. However, not only does ordinary energization heating take time to raise temperature, but there are a number of problems that impede operating efficiency, including the many cases where the large temperature dependence of electrical resistance requires adjustments to applied current and voltage.

Moreover, as shown in Patent Document 2, although a method using high frequency induction heating is disclosed, in this case the nozzle is made of a conductive refractory material, particularly a refractory material in a graphite system. In this case, in the same manner as with direct energization, there is a possibility of electrical current leaking.

Furthermore, as shown in Patent Document 3, in the method of disposing a heating element around the outer periphery of the nozzle, the gap between the heating element and the nozzle body acts as a thermal resistance, as does the nozzle body itself, giving extremely poor thermal efficiency. Despite the fact that the temperature of the heating element must be considerably high to raise the temperature of the nozzle inner periphery which contacts the molten steel, the block heater disclosed in Patent Document 3, even when used in conjunction with a sheath heater, can only raise the temperature to 850° C. or thereabouts. Also problematic are the service life and lifespan of the heating element.

Furthermore, in Patent Document 4, only the construction of a carbon heater is disclosed, with no mention of its application to a submerged nozzle.

Moreover, when performing preheating, in a preheating method using a conventional gas burner, the nozzle is preheated by a combustion gas at a standby position removed from the casting location, and subsequently, the nozzle is transported to the casting location and fitted to the tundish, at which point the supply of molten steel (also known as molten steel injection or molten steel pouring) begins. Consequently, because the nozzle is in a cooling state from the point when preheating finishes, even if the nozzle is initially heated to 1000° C. or higher, the temperature of the submerged nozzle will already have dropped significantly by the time casting begins (typically 5 to 15 minutes or so elapses from the time preheating ends until molten steel injection begins).

Consequently, a problem occurs in that even if preheating is performed, the sensible heat of the molten metal is lost to the nozzle, causing a solid layer of molten steel to form on the inside wall of the nozzle, and the nozzle to become blocked during casting.

DISCLOSURE OF INVENTION

In accordance with the above circumstances, an object of the present invention is to provide a continuous casting method and nozzle heating device which, without depending on the blowing of argon gas, and without disadvantages such as current leakage or deterioration of refractory materials, is capable of preventing the adhesion of adhesion by efficiently heating the nozzle, enabling continuous casting to be performed in a continuous manner.

Means for Solving the Problem

The inventors of the present invention investigated the extent to which the temperature of the outside surface of the nozzle reduces from the end of preheating to the start of molten steel pouring, using an actual continuous casting nozzle requiring seven minutes from the end of gas burner preheating until molten steel pouring begins. The results are shown in FIG. 6. As shown in FIG. 6, a large drop in temperature was observed of approximately 200° C. at 5 minutes after gas burner preheating ended and almost 300° C. at seven minutes. Therefore, even if preheating is initially performed to 1000° C. or higher, when pouring starts, the temperature of the nozzle outside surface reduces to less than 1000° C. (less than 800° C. in FIG. 6), which can cause a solid layer of molten steel to form on the inside wall of the nozzle. The inventors recognize there is a possibility that the nozzle blocks during casting.

The inventors of the present invention also discovered that if the outside surface temperature of the nozzle is equal to or higher than 1000° C. when molten steel pouring starts, nozzle blockages seldom occur during casting.

In light of this knowledge, the inventors arrived at the present invention.

The present invention has the following aspects:

(1) That is, a continuous casting method is provided in which the outside surface of a continuous casting nozzle, which supplies molten metal into a mold while immersed in the molten metal in the mold, is heated to 1000° C. or higher by a nozzle heating device comprising an external heater which performs radiant heating, while the molten metal passes through the continuous casting nozzle. Also provided is a device which can, as required, heat the outside surface of the continuous casting nozzle to such a high temperature (for example 1600° C.).

(2) In the continuous casting method described in (1) above, the external heater may be a carbon heater.

(3) In the continuous casting method described in (1) above, a silicon carbide heater or a molybdenum silicide heater may be used as the external heater.

(4) In the continuous casting method described in (1) above, when beginning to supply the molten metal into the mold, the outside surface of the continuous casting nozzle may be preheated by the heater to 1000° C. or higher.

(5) In the continuous casting method described in (1) above, when beginning to supply the molten metal into the mold, the outside surface of the continuous casting nozzle may be preheated by the heater to 1600° C. or higher.

(6) Furthermore, the present invention provides a nozzle heating device which heats the outside surface of a continuous casting nozzle for supplying molten metal into a mold while immersed in the molten metal in the mold to 1000° C. or higher, the nozzle heating device comprising: an insulator provided so as to surround the outside of the continuous casting nozzle leaving a gap; and an external heater which performs radiant heating, provided on the inside surface of the insulator facing the continuous casting nozzle.

(7) In the nozzle heating device described in (6) above, the external heater may be a carbon heater.

(8) In the nozzle heating device described in (6) above, the external heater may be a silicon carbide heater or a molybdenum silicide heater.

(9) In the nozzle heating device described in (6) above, the external heater may be covered by a ceramic protective tube with reduced internal pressure.

(10) In the nozzle heating device described in (6) above, the insulator may be composed of multiple insulating segments.

Effects of the Invention

According to the present invention, the outside surface of the continuous casting nozzle is maintained at 1000° C. or higher by the nozzle heating device. As a result, without depending on the blowing of argon gas which can cause defects, the temperature of the continuous casting nozzle can be raised and maintained without problems such as current leakage or the deterioration of refractory materials occurring, thereby preventing the adhesion of non-metallic oxides and base metal. As a result, blocking of the continuous casting nozzle by adhesion can be prevented and the number of consecutive continuous casting charges can be increased.

BEST MODE FOR CARRYING OUT THE INVENTION

In a continuous casting method of the present invention, the outside surface of a continuous casting nozzle which supplies molten metal into a mold while immersed in the molten metal in the mold is heated to 1000° C. or higher by a nozzle heating device comprising a radiant heater, while the molten metal passes through the continuous casting nozzle.

Furthermore, as nozzle preheating methods generally performed up to now, there has been adopted; a method of performing nozzle preheating at a standby position of the tundish, or in the case of an externally mounted submerged nozzle, a method of preheating the submerged nozzle independently in a preheating furnace as needed before fitting the nozzle to the tundish.

Also in the case of preheating using the radiant heating device of the present invention, similarly to the conventional methods, when performing preheating the submerged nozzle can be preheated at a standby position. Furthermore, in an embodiment of the present invention, preheating can be performed as the tundish is being moved to the casting position. Moreover in another aspect of the present invention, preheating begins with the tundish located at the casting position, enabling nozzle heating to be performed without interruption at the beginning of and during the casting process.

Conventionally, the submerged nozzle heated by a gas burner radiates heat and becomes a stand-by state during the interval from when molten steel is poured from the ladle into the tundish until the molten steel in the tundish reaches the prescribed quantity.

During this interval, the inside surface temperature of the nozzle falls from approximately 1100° C. to 1050° C. after 4 to 5 minutes, and the outside surface temperature falls to approximately 750 to 800° C.

On the other hand, after the molten steel in the tundish reaches the prescribed amount, even after the molten steel has been poured into the mold from the tundish through the submerged nozzle, the outside surface temperature of the submerged nozzle is 900° C. or thereabouts, showing that a large amount of heat had been released from the outside surface of the submerged nozzle to the atmosphere. Such heat release is a major cause of base metal adhesion to the inside surface of the nozzle.

The present invention fundamentally reexamines the approach to these problems, and provides a method of continually heating the nozzle outside surface, including the period from the end of preheating to the midst of molten metal (molten steel) pouring, preventing the discharge of heat from the nozzle outside surface.

Figure 6:
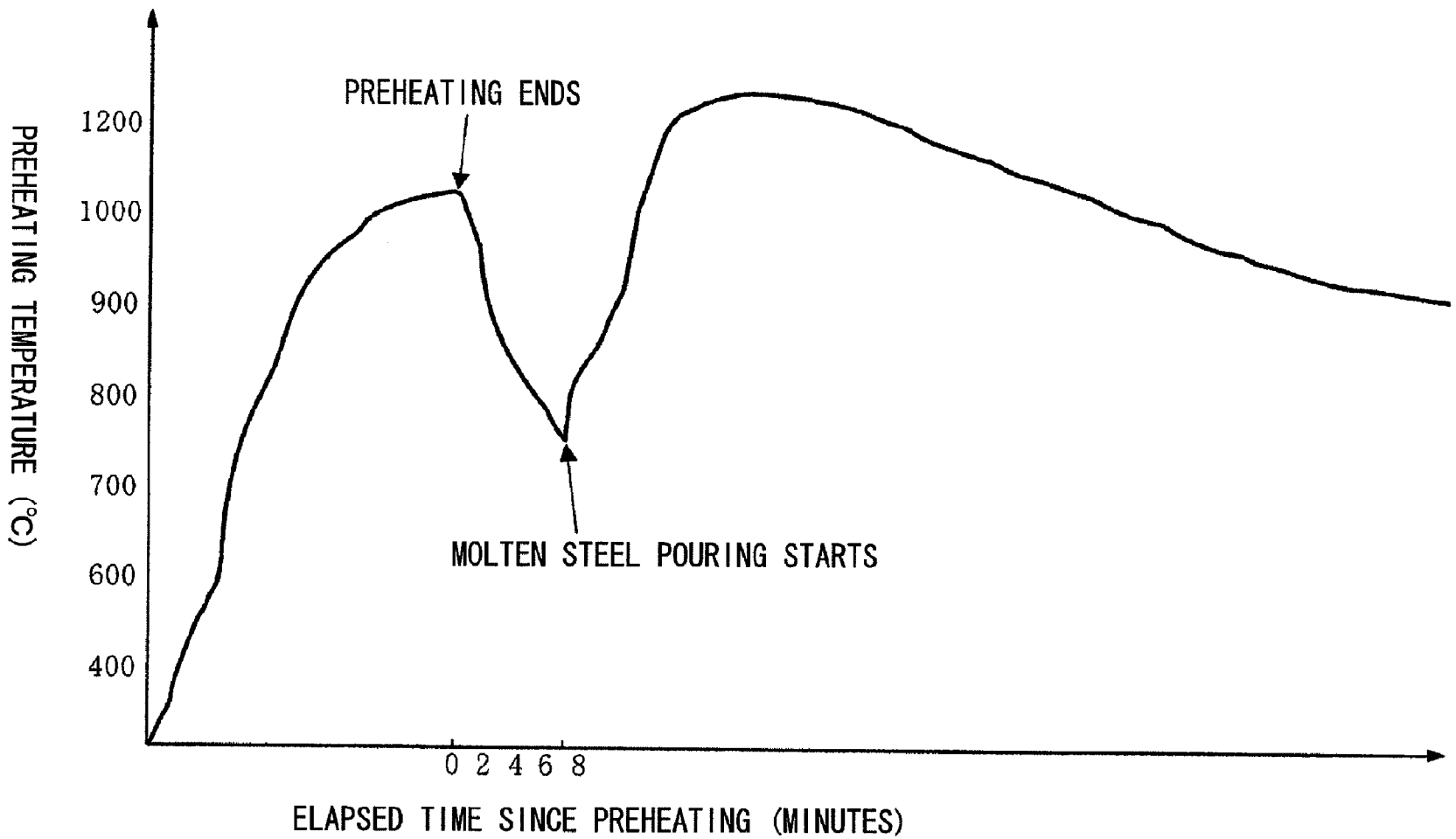
FIG. 6 is a graph showing the outside surface temperature of the continuous casting nozzle from the start of preheating to the midst of molten steel pouring.

Here, as is apparent from FIG. 6 which shows measurements of the outside surface temperature of the continuous casting nozzle from the start of preheating to the midst of molten steel pouring, in the period from the end of preheating to the midst of molten steel pouring, the nozzle outside surface temperature is lowest at the start of molten steel pouring. Therefore, making the nozzle outside surface temperature at this time higher than in conventional methods, particularly a temperature of 1000° C. or greater as the test results indicate, is considered of utmost importance in terms of preventing the adhesion of molten steel to the inside surface of the nozzle.

The wall thickness of the nozzle is normally 30 mm or thereabouts, which is generally constant regardless of nozzle type. Although there is some difference in the thermal conductivity of the nozzle wall, because the temperature difference between the outside surface and inside surface of the nozzle does not differ to any great degree between nozzle types (for example a difference of 50 to 100° C.), the present invention is applicable to any nozzle type.

As the temperature control reference for when heating, external heating in an amount equal to or greater than the amount of heat lost to heat transfer through the nozzle wall during molten steel pouring is made the reference, so that the outside surface of the submerged nozzle can be maintained at 1000° C. or higher.

The reason is that when the outside surface temperature of the submerged nozzle is less than 1000° C., as described above, significant heat is discharged to the atmosphere from the nozzle outside surface, increasing the likelihood of base metal adhering to the nozzle inside surface.

As the location for the temperature control reference, a location near where the submerged nozzle attaches is made the reference position. This is because since the submerged nozzle is subjected to radiant heating from the molten steel in the mold during pouring, it is desirable to make the outside surface temperature at the neck region where the submerged nozzle is secured, where the effect of this radiant heating is judged to be minimal, a reference point.

Furthermore, regarding the heated range in the height direction of the submerged nozzle due to the nozzle heating device, this is preferably 50% or more of the height dimension of the submerged nozzle, and is such a range that the nozzle heating device does not contact the molten steel in the mold. This is because if the heated range is less than 50% of the height dimension of the submerged nozzle, keeping the entire outside surface of the submerged nozzle at a temperature of 1000° C. or higher is difficult, and the adhesion of base metal may occur at some parts of the nozzle inside surface.

As the nozzle heating device which performs radiant heating of the submerged nozzle from outside, using a radiant heater with an absolute heating temperature of 1000° C. or higher is necessary, but particularly, most desirable is a heater with a fast heating rate and a high absolute heating temperature. Examples of such a heater include carbon heaters, silicon carbide (SiC) heaters, and molybdenum silicide ($MoSi_2$) heaters.

Carbon heaters have a fast heating rate and are therefore suitable for rapid heating, but because the carbon serving that is the heating element is prone to oxidative degradation, silica glass is provided as a protective tube around the outer periphery of the carbon heater. However, because the heat resistance of this protective tube is relatively low at 1100° C. or thereabouts, when working with higher temperatures a SiC or $MoSi_2$ heater is preferred.

A SiC heater typically operates at a temperature of 1450° C., but can rise in temperature relatively quickly, at a rate of 20° C./minute or thereabouts. On the other hand, a $MoSi_2$ heater is capable of operating at a temperature of 1700° C., but because the thermal shock resistance of the heater itself is poor, the rate of temperature increase is often limited to 5 to 10° C./minute or thereabouts. In a SiC heater, because the outside surface is protected by an oxide layer made of $SiO_2$, a SiC heater can be used in open air without a protective tube.

Furthermore, in the case of a $MoSi_2$ heater also, because the outside surface is protected by an oxide layer, the heater can be used in open air without a protective tube. Moreover, the heater can be disposed in the same manner as a SiC heater.

Accordingly, in consideration of the heating temperature and preheating time of the submerged nozzle, it is preferable to select the heater type.

As the nozzle heating device, a device is employed which comprises; an insulator provided so as to surround the outside of the submerged nozzle serving as the continuous casting nozzle leaving a gap, and a carbon heater provided on the inside surface of the insulator facing the submerged nozzle. In its preferred form the insulator is a cylindrical shape, such as a cylinder, elliptical cylinder, or polygonal cylinder.

The gap between the outside surface of the submerged nozzle and the carbon heater provided on the inside surface of the insulator of the nozzle heating device is preferably 50 mm or less.

If a wider gap is used, the heating efficiency of the submerged nozzle worsens. On the other hand, if too narrow a gap is used, it cannot accommodate variations in the mounting accuracy of the submerged nozzle. Because the smaller the gap between the carbon heater and the submerged nozzle the greater the heating efficiency, to prevent contact between the carbon heater and the submerged nozzle since heating efficiency is progressive, a gap is preferably secured which is as narrow as possible within an approximate ±10 mm tolerance of the mounting accuracy of the submerged nozzle.

By employing a nozzle heating device in such a configuration, the submerged nozzle can be efficiently heated without external dissipation of the heat from the carbon heater.

Furthermore, because there is no need to embed a heating resistor or the like in the continuous casting submerged nozzle, and the nozzle need not be processed by expensive materials, a simple construction can be employed. As a result, the manufacturing costs of the continuous casting submerged nozzle can be kept low. In addition, because there is design flexibility in terms of the shape of the carbon heater, with little exactness required in the placement and the like thereof, the method of the present embodiment can be applied easily to actual operations.

In the present embodiment, when a carbon heater is employed as the radiant heater, preferably the heater is covered by a ceramic protective tube with reduced internal pressure.

As a specific example of the material of the protective tube, typically glass is used, but at temperatures exceeding 1000° C., in the case of silicate glass, because devitrification occurs with repeated use and softening deformation occurs at high temperatures, heating in excess of 1000° C. cannot be performed. Thus, depending on the target temperature during heating, crystallized glass or sapphire glass or the like is most preferably used as the material for the protective tube.

By covering the carbon heater with the protective tube, a situation in which the heat generating parts of the carbon heater contact the atmosphere and suffer oxidative degradation can be prevented, and hence the long life of the nozzle heating device can be assured.

In the present invention, a construction in which the insulator is composed of multiple insulating segments is preferred. For example, if the insulator is a cylindrical shape, an insulator can be employed which is divided into two segments along a single plane that includes the axis of the cylindrical body.

The carbon heaters or the like serving as the radiant heaters disposed inside the insulator are preferably supplied with power independently at each of the insulating segments.

By building the insulator from a plurality of insulating segments, with the submerged nozzle still attached to the tundish, the nozzle heating device can be removed and displaced from a position directly above the mold. Consequently, even if a problem occurs with the submerged nozzle during molten metal pouring, the nozzle heating device can be removed and the submerged nozzle is easily replaced.

A fundamental aspect of the present invention is that, from the start of preheating to the midst of molten steel pouring, an external radiant heater is used to perform heating. However in the context of preheating only, a conventional technique using a gas burner or the like may also be used. In this case, because in most cases an insulating material is provided around the outside of the submerged nozzle during preheating, after preheating the insulating material is removed from regions of the nozzle outside surface which are to be heated by the radiant heater, before transitioning to heating by the radiant heater. By removing the insulating material from the regions corresponding to the radiant heater, the radiant heating efficiency can be improved. If a molybdenum heater is used as the radiant heater, because the heating rate is relatively slow, by performing all or the initial stage of preheating using a conventional technique (such as a gas burner) as described above, the preheating time can be reduced.

Moreover, when using a carbon heater, during molten steel pouring, because there is a possibility that the rise in the nozzle outside surface temperature might cause the carbon heater protective tube to overheat and suffer damage, even more preferably an insulating material is provided between the carbon heater and the submerged nozzle.

An embodiment of the present invention is described below with reference to the drawings.

Figure 1:
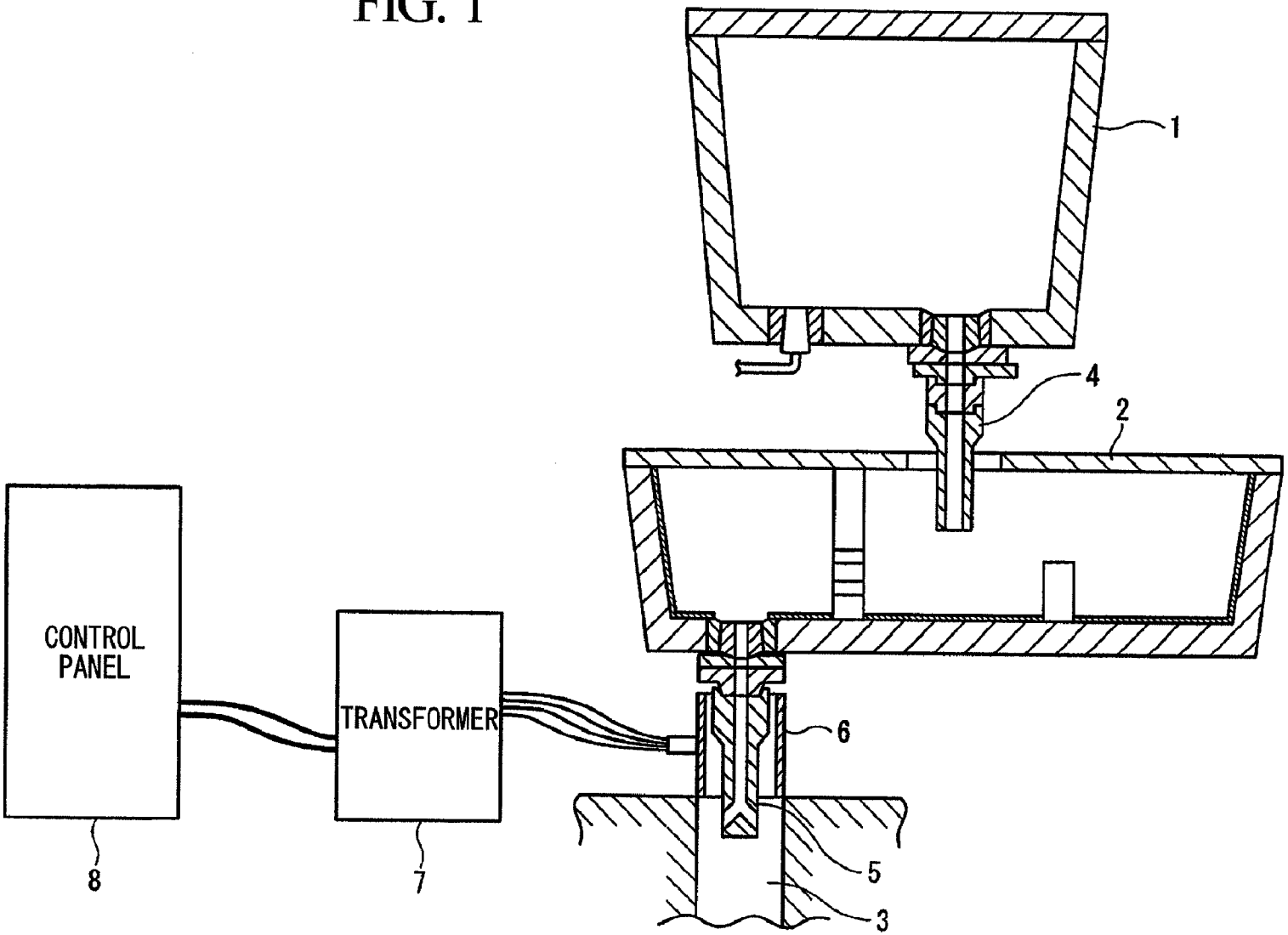
FIG. 1 is a schematic diagram showing the construction of a continuous casting facility according to an embodiment of the present invention.

FIG. 1 shows a continuous casting facility according to the present embodiment. This continuous casting facility comprises; a ladle 1, a tundish 2, and a mold 3. Furthermore, although omitted from the figure, at the bottom of the mold 3, rollers are provided.

In this continuous casting facility, molten steel that has undergone secondary smelting, is supplied to the ladle 1 and transported, the molten steel inside the ladle 1 is supplied to the tundish 2, and the molten steel is then supplied into the mold 3 from an opening formed in the base of the tundish 2.

The supply of molten steel from the ladle 1 to the tundish 2 is performed by a long nozzle 4 provided on a molten steel supply opening formed at the base of the ladle 1. Moreover the supply of molten steel from the tundish 2 to the mold 3 is performed by an submerged nozzle 5 provided on a molten steel supply opening formed at the base of the tundish 2.

The submerged nozzle 5 is heated by a nozzle heating device 6 disposed directly above the mold 3.

To the nozzle heating device 6, a transformer 7 and a control panel 8 are connected. Power supplied from a step-up transformer (not shown) to the control panel 8 is supplied to the nozzle heating device 6 via the transformer 7, and the nozzle heating device 6 heats the submerged nozzle 5 by the supplied power.

Figure 2:
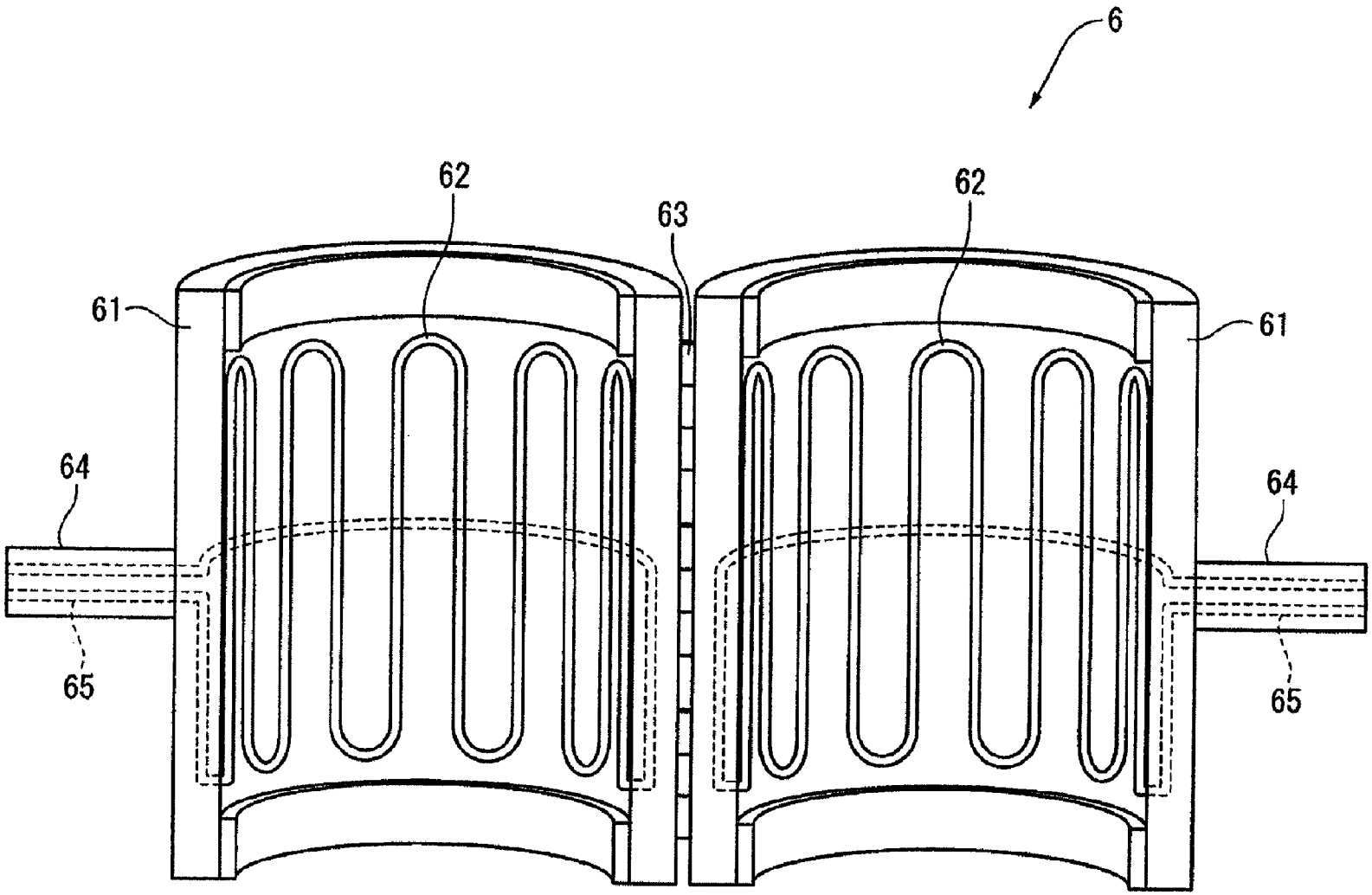
FIG. 2 is a partial perspective view showing the construction of a nozzle heating device according to the same embodiment.

The nozzle heating device 6 has a cylindrical shape, and as shown in FIG. 2, comprises two insulating sections 61 divided at a single virtual plane that includes the axis of the cylinder, and carbon heaters 62 provided in the respective cylinder inside surfaces of the insulating sections 61.

A hinge 63 is provided at one edge of the insulating sections 61, and by means of this hinge 63 the two segments of the nozzle heating device 6 are able to open and close. Furthermore, a support arm 64 is provided at the other edge of the insulating sections 61. During heating of the submerged nozzle 5, this support arm 64 supports the nozzle heating device 6 in a suspended manner directly above the mold 3.

The insulating sections 61 are thick walled molded components with a semi-circular cross section, and are composed of refractory materials or the like so as to withstand the heat of the molten steel. On the inside surface of the insulating sections 61, the carbon heaters 62 are provided.

The radius of the semicircle that forms the inside surface of the insulating section 61 is such that, when disposed coaxially with the circular cross section of the submerged nozzle 5, a gap of 50 mm or less for example is formed between the carbon heater 62 and the outside surface of the submerged nozzle 5. As a result, contact between the nozzle heating device 6 and the submerged nozzle 5 can be avoided when the nozzle heating device 6 is fitted.

Furthermore, the height dimension of the insulating sections 61 is such that at least 50% of the height of the submerged nozzle 5 is covered, and is preferably such that the entirety of the submerged nozzle 5 can be heated.

The carbon heater 62 extends along the axial direction of the cylinder formed by combining the two insulating sections 61, and bends 180 degrees near the end of the insulating sections 61. As a result, the carbon heater 62 meanders back and forth along the circumferential direction of the inside surface of the insulating sections 61. This carbon heater 62 comprises a carbon heating element, and a protective tube which covers this carbon heating element, and by depressurizing the inside of the protective tube, the carbon heating element is prevented from contacting the atmosphere and suffering oxidative degradation. As the material of the protective tube, because the outside surface of the submerged nozzle 5 is heated to 1000° C., the material used must be able to withstand such a temperature. For example, crystallized glass or sapphire glass can be used.

Conductive wires 65 are connected to the ends of the carbon heaters 62. The conductive wires 65 pass through the inside of the insulating sections 61, lead out from the support arms 64 to the outside, and connect to the transformer 7 described above. The conductive wires 65 are connected independently to the carbon heater 62 of each insulating section 61, so that the wires do not interfere and break when the two insulating sections 61 are changed from a jointly closed state to an open state.

In the present embodiment, a nozzle heating device 6 is employed which incorporates a carbon heater 62 in a meandering state along the circumferential direction on the inside surface of the insulating sections 61. However, the present embodiment is not limited to this configuration, and as shown by the modified example in FIG. 3, for example, a nozzle heating device 6A in which the carbon heaters 62 are disposed so as to meander in the axial direction of the cylindrical body formed by combining the pair of insulating sections 61 can be employed.

Figure 4:
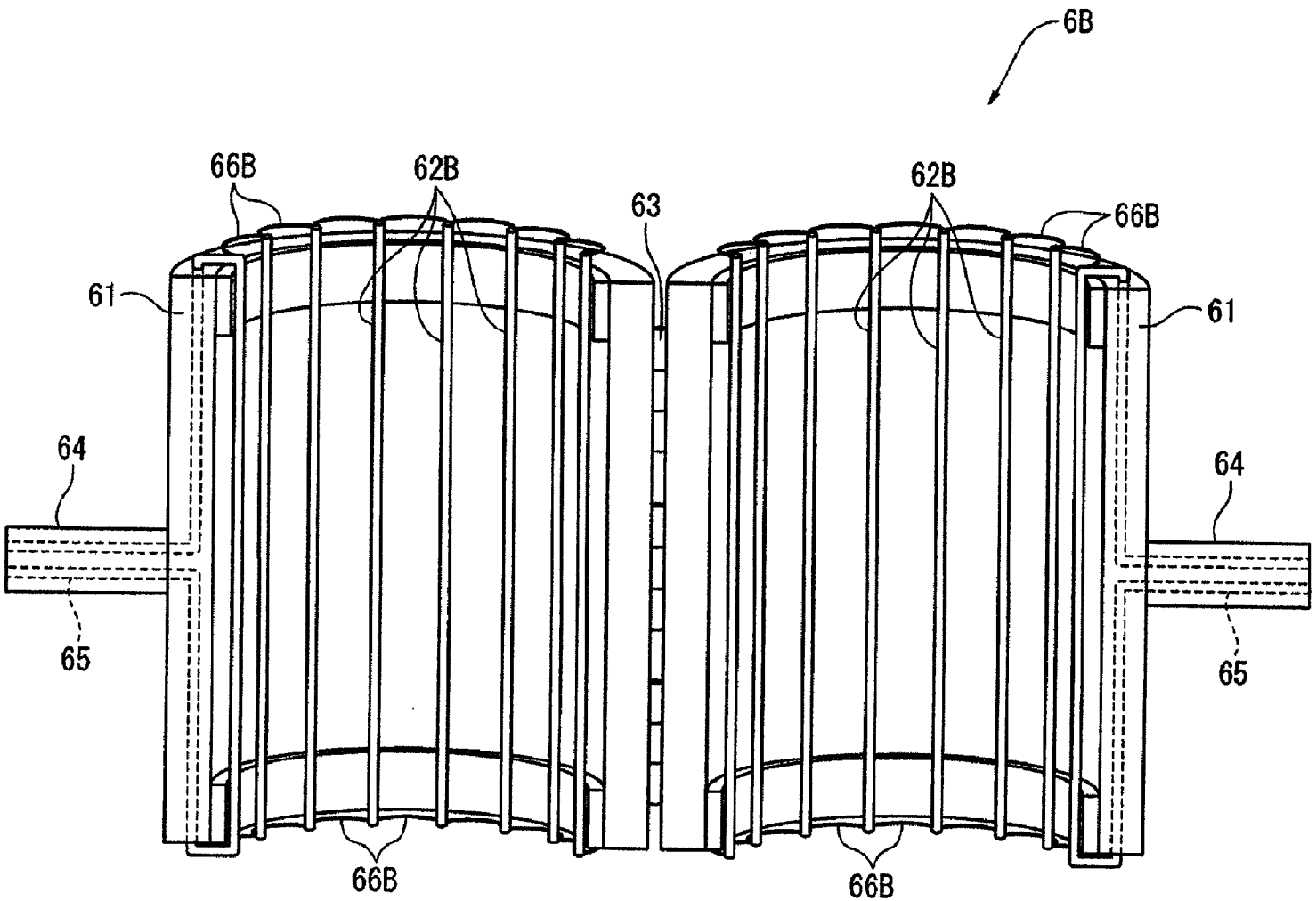
FIG. 4 is a partial perspective view of another modified example of the embodiment, showing the construction of the nozzle heating device.

In addition, as shown by another modified example in FIG. 4, a nozzle heating device 6B can be employed in which a plurality of SiC heaters 62B are disposed. This nozzle heating device 6B has a construction in which the plurality of easily retained rod shaped SiC heaters 62B are disposed in parallel, and these SiC heaters 62B are connected in series by wires 66B, and is otherwise constructed in the same manner as FIG. 2. Here, a case in which the rod shaped SiC heaters 62B are connected is shown, but to minimize the dead space below the furnace, a construction in which terminals are provided at the top of U-shaped SiC heaters or in which W-shaped SiC heaters are concatenated may be used.

When the nozzle heating device 6 described above is fitted to the continuous casting facility, with the submerged nozzle 5 fitted to the tundish 2, the nozzle heating device 6 is placed near the submerged nozzle 5 with the insulating sections 61 still open. Subsequently, the insulating sections 61 are closed so as to surround the submerged nozzle 5, and are held directly above the mold 3 by the support arm 64.

Next, a continuous casting method using this nozzle heating device 6 is described.

First, power is supplied to the nozzle heating device 6 to preheat the submerged nozzle 5. When the outside surface of the submerged nozzle 5 reaches equal to or higher than 1000° C., continuous casting begins with the supply of molten steel from the ladle 1 to the tundish 2.

During continuous casting, the outside surface of the submerged nozzle 5 is heated to temperatures of equal to or higher than 1000° C. by the nozzle heating device 6. As described previously in the description of the carbon heater, because the heat resistance temperature of the protective tube is relatively low, to prevent overheating of the carbon heater protective tube, at the beginning of the casting process, preferably an insulating material is attached between the submerged nozzle 5 and the carbon heater to extend the lifetime of the carbon heater.

Figure 5A:
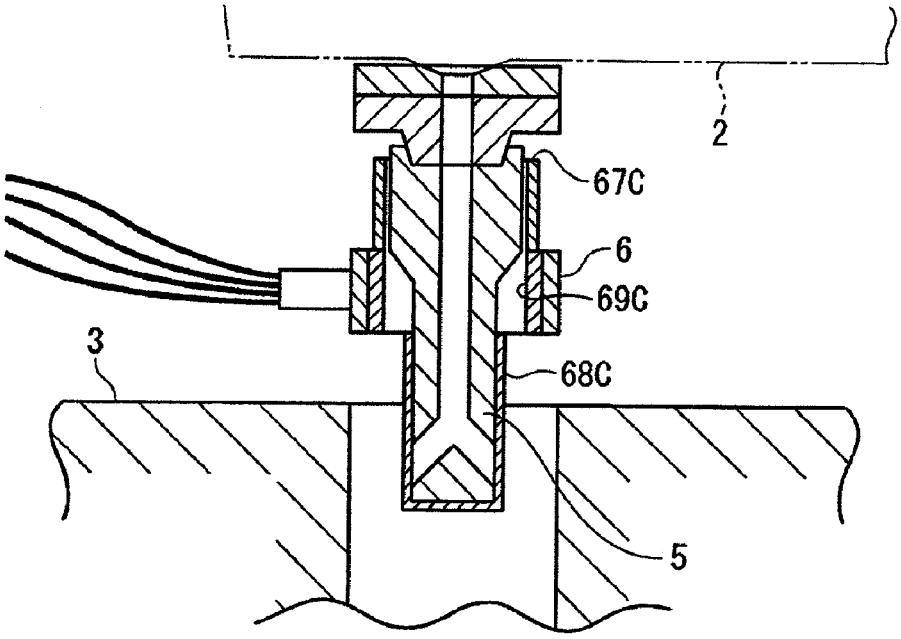
FIG. 5A is an enlarged cross-sectional view of the nozzle heating device of the continuous casting facility of the embodiment, showing continuous casting prior to molten steel pouring.
Figure 5B:
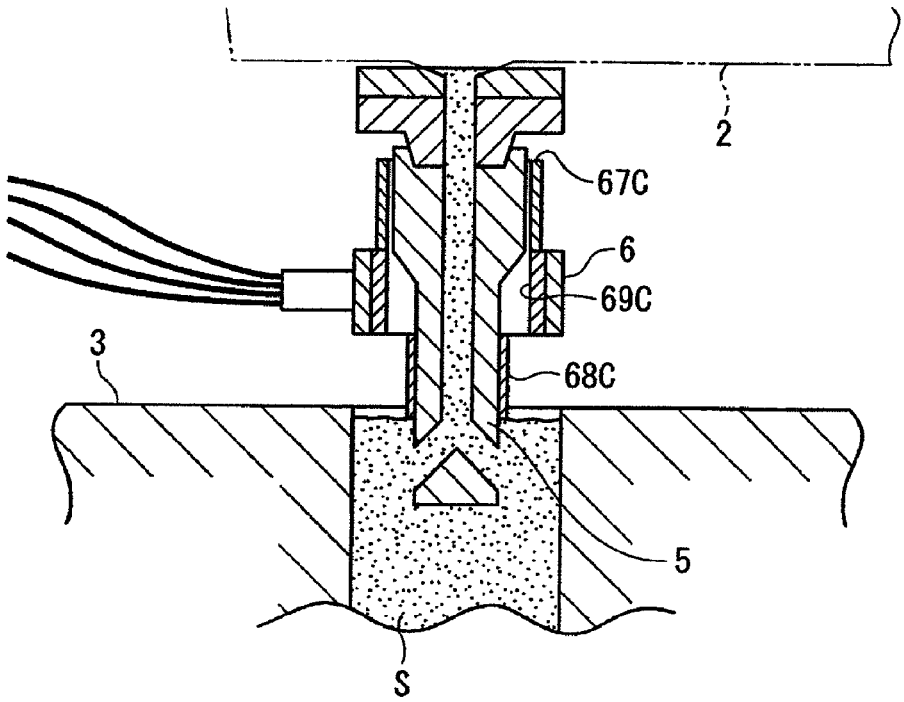
FIG. 5B is an enlarged cross-sectional view of the nozzle heating device of the continuous casting facility of the embodiment, showing continuous casting during molten steel pouring.

For example, FIG. 5A and FIG. 5B show enlarged views of an example in which the surface of the submerged nozzle 5 in FIG. 1 is covered by an insulating material. FIG. 5A is an enlarged cross-sectional view of the nozzle heating device 6 prior to molten steel pouring. FIG. 5B is an enlarged cross-sectional view of the nozzle heating device 6 during molten steel pouring (during casting).

By attaching the nozzle heating device 6 to the outer periphery of the center in the length direction of the submerged nozzle 5, and attaching a first insulating material 67C and a second insulating material 68C above and below the nozzle heating device 6, heat loss from the portion not covered by the nozzle heating device 6 can be prevented. By the second insulating material 68C covering the lower part of the submerged nozzle 5 to the bottom end, the amount of heat released from the parts of the submerged nozzle 5 not covered by the nozzle heating device 6 can be minimized.

Of this second insulating material 68C, the portion immersed in the molten steel S inside the mold 3 at the beginning of casting, is dissolved by the heat of the molten steel S, and does not require removal. This is shown in FIG. 5B. On the other hand, in the portion where the nozzle heating device 6 is located, to protect the carbon heater 62 during casting, functionality that enables the attachment and removal of a third insulating material 69C between the submerged nozzle 5 and the carbon heater 62 can be provided.

The third insulating material 69C is preferably also provided in the construction shown in FIG. 1. Moreover, when employing a nozzle heating device 6B having SiC heaters 62B as shown in FIG. 4, the third insulating material 69C need not be provided. Furthermore, in FIG. 5A and FIG. 5B, as the height dimension of the nozzle heating device 6, sufficient height to cover only the third insulating material 69C is exemplified. However a height dimension may be used which also covers at least one of the first insulating material 67C and the second insulating material 68C.

EXAMPLES

The effects when performing continuous casting while heating the submerged nozzle (continuous casting nozzle) 5 using the nozzle heating device 6 described above were verified.

The nozzle heating device 6A described in the embodiments above was fitted to the submerged nozzle 5 of one of the strands of a 2 strand 60 ton tundish 2, and a comparison of casting 350 tons of molten steel in 6 heats was conducted. The primary testing conditions and evaluation results of examples 1 to 3 are shown in Table 1 below.

Example 1

Figure 3:
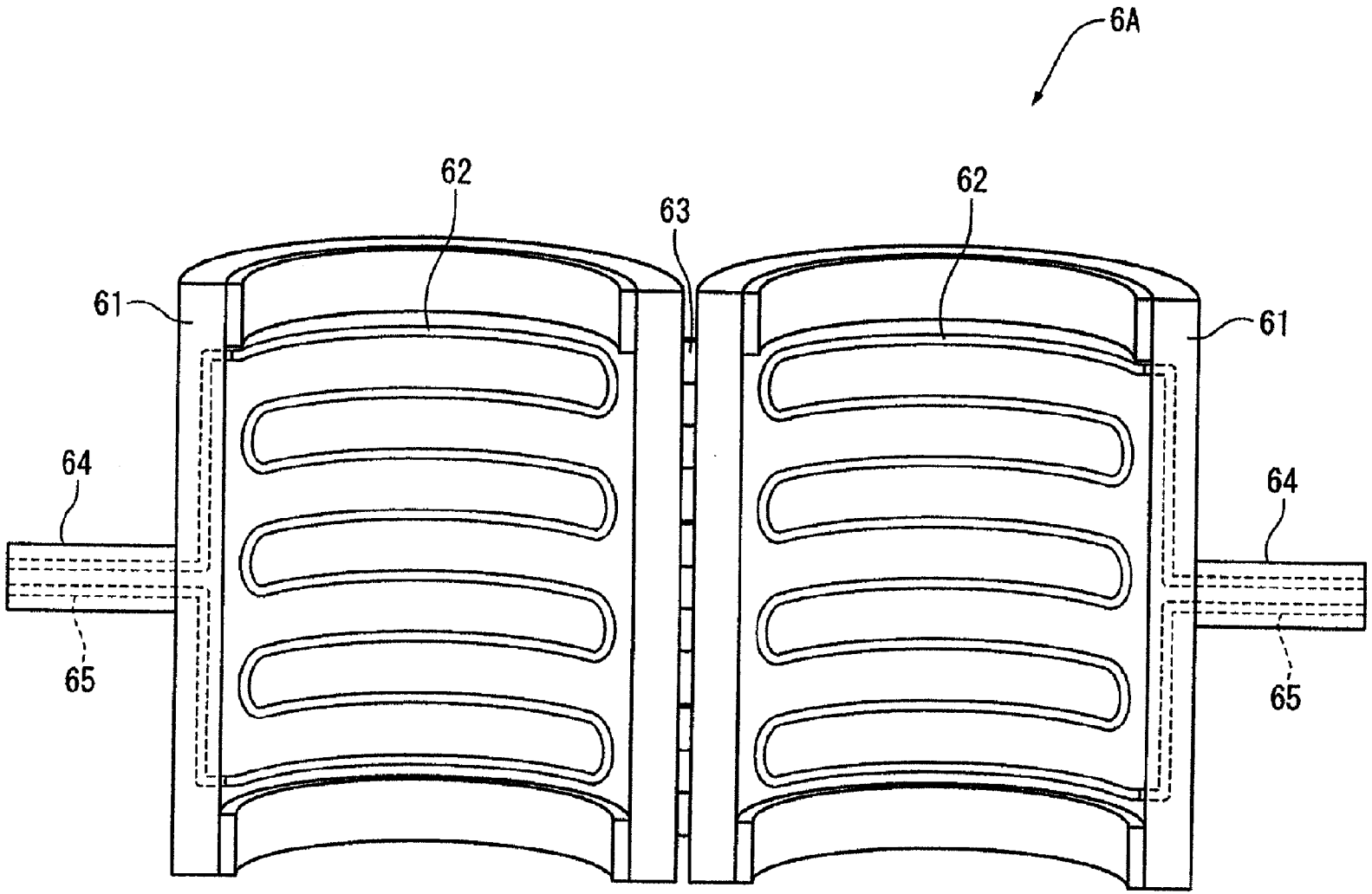
FIG. 3 is a partial perspective view of a modified example of the same embodiment, showing the construction of the nozzle heating device.

In example 1, the nozzle heating device 6A comprising the carbon heater 62 shown in FIG. 3 was used. First, the submerged nozzle 5 was preheated at the nozzle standby position using the nozzle heating device 6A, and then, heating of the submerged nozzle 5 by the nozzle heating device 6A was continued while the submerged nozzle 5 was fitted to the tundish 2. Subsequently, after attaching the third insulating material 69C between the submerged nozzle 5 and the carbon heater 62 (to prevent the heater protective tube from overheating when the outside surface temperature of the submerged nozzle 5 is raised by the molten metal inside the submerged nozzle 5 after casting starts), molten steel pouring (supply) was started. That the outside surface temperature of the submerged nozzle 5 was equal to or higher than 1000° C. at the start of molten steel pouring was confirmed by a thermocouple attached to the outside surface of the submerged nozzle 5.

From when the submerged nozzle 5 had completed preheating at the standby position (from the time when the nozzle started to move), approximately 10 minutes was required after the submerged nozzle 5 was fitted to the tundish 2 before molten steel pouring began. Moreover, heating of the submerged nozzle 5 by the nozzle heating device 6A was interrupted for a 1 minute period when attaching the third insulating material 69C between the submerged nozzle 5 and the carbon heater 62.

Example 2

In example 2, using the SiC heaters 62B shown in FIG. 4 instead of the carbon heater 62 of example 1 above, in the same manner as in example 1, first the submerged nozzle 5 was preheated at the nozzle standby position using the nozzle heating device 6A. Then, heating of the submerged nozzle 5 by the nozzle heating device 6B was continued while the submerged nozzle 5 was fitted to the tundish 2. the SiC heaters 62B differs from the carbon heater 62, because there was no need to attach the third insulating material 69C between the submerged nozzle 5 and the SiC heaters 62B, heating of the submerged nozzle 5 was not interrupted. That the outside surface temperature of the submerged nozzle 5 was 1550° C. at the start of molten steel pouring, was confirmed by a thermocouple attached to the outside surface of the submerged nozzle 5.

Example 3

In example 3, instead of the carbon heater 62 of example 1, the material of the carbon heater 62B shown in FIG. 4 was changed from SiC to $MoSi_2$, and the construction was changed from a rod shape to a U shape, giving $MoSi_2$ heaters in which the top ends of adjacent U-shaped heaters were connected in series. Then in the same manner as in example 1, first the submerged nozzle 5 was preheated at the nozzle standby position using the nozzle heating device 6B. Then, heating of the submerged nozzle 5 by the nozzle heating device 6B was continued while the submerged nozzle 5 was fitted to the tundish 2. The $MoSi_2$ heater differs from the carbon heater 62, because there was no need to attach the third insulating material 69C between the submerged nozzle 5 and the $MoSi_2$ heaters, heating of the submerged nozzle 5 was not interrupted. That the outside surface temperature of the submerged nozzle 5 was 1600° C. at the start of molten steel pouring, was confirmed by a thermocouple attached to the outside surface of the submerged nozzle 5.

Comparative Example 1

In conjunction with the evaluations of the above examples, a comparison was conducted in which 350 tons of molten steel was cast in 6 heats, using the submerged nozzle of the other strand of the 2 strand 60 ton tundish 2 preheated by a gas burner in the conventional manner. In comparative example 1, argon (Ar) gas was blown at a rate of 5 liters/minute. The evaluation results of comparative example 1 are shown in Table 1 below.

The outside surface temperature of the submerged nozzle at the start of molten steel pouring was confirmed to have dropped, to 800° C., in the 10 minute period while heating was interrupted after preheating to before molten steel pouring began, by a thermocouple attached to the outside surface of the submerged nozzle 5.

At this time, in the strand of the examples where continuous casting was performed using the nozzle heating device 6 without blowing argon gas, surface variation and drift were significantly reduced in comparison with the strand of comparative example 1 which used argon gas.

Furthermore, in the strand of comparative example 1, the degree of opening of the submerged nozzle 5 had to be gradually increased as casting progressed, ultimately requiring that continuous casting be interrupted during the fourth heat, so that the submerged nozzle 5 could be exchanged.

Comparative Example 2

Next, in the same manner, with one of the strands of a 2 strand 60 ton tundish 2 the same as in the examples above, as comparative example 2 the outside surface of the other strand was heated to 800° C. by a high frequency induction heating coil during continuous casting. In comparative example 2, argon (Ar) gas was blown at a rate of 5 liters/minute. The evaluation results of comparative example 2 are shown in Table 1 below.

The outside surface temperature of the submerged nozzle 5 at the start of molten steel pouring was confirmed to have dropped, to 650° C., in the 10 minute period while heating was interrupted after preheating to before molten steel pouring began, by a thermocouple attached to the outside surface of the submerged nozzle 5.

In comparative example 2, continuous casting was interrupted when a blockage occurred during the fifth heat.

In contrast, in the strand where, using the nozzle heating device 6 of the embodiments, the outside surface of the submerged nozzle 5 was maintained at a temperature of 1000° C. or higher by a carbon heater, including the wait time from the end of preheating until the start of casting, 6 charges of molten steel comprising 350 tons per charge were continuously cast without any intervention such as replacing the submerged nozzle 5.

After casting was completed, the submerged nozzle was recovered and the condition of the inside surface was checked. Although 10 mm or more of a large quantity of alumina and base metal were deposited in the strand of comparative example 2 where casting was interrupted, the strand of the examples showed few adhesion.

Next, in the same manner, with one of the strands of a 2 strand 60 ton tundish 2 the same as in the examples above, as comparative example 3 the outside surface of the other strand was heated to 1100° C. by a high frequency induction heating coil during continuous casting. In comparative example 3, blowing of argon (Ar) gas was not performed. The evaluation results of comparative example 3 are shown in Table 1 below.

The outside surface temperature of the submerged nozzle 5 at the start of molten steel pouring was confirmed to have dropped, to 850° C., in the 10 minute period while heating was interrupted after preheating to before molten steel pouring began, by a thermocouple attached to the outside surface of the submerged nozzle 5.

In comparative example 3, continuous casting was interrupted when a blockage occurred during the fifth heat.

In this manner, in the strand where, using the nozzle heating device 6 of the embodiments, the outside surface of the submerged nozzle 5 was maintained at a temperature of 1000° C. or higher by a carbon heater, including the wait time from the end of preheating until the start of casting, 6 charges of molten steel comprising 350 tons per charge were continuously cast without any intervention such as replacing the submerged nozzle 5.

After casting was completed, the submerged nozzle 5 was recovered and the condition of the inside surface was checked. Although a thickness of 10 mm or more of a large quantity of alumina and base metal were deposited in the strand of comparative example 3 where casting was interrupted, the strand of the above respective examples showed few adhesion.

TABLE 1

| | Example 1 | Example 2 | Example 2 | Comparative example 1 | Comparative example 2 | Comparative example 3 |
|---|---|---|---|---|---|---|
| Presence/absence of heating, and heating temperature | Carbon heater<br>1000° C. or higher when casting begins Heating performed during casting Insulating material used | SiC heater<br>1550° C. when casting begins Heating performed during casting No insulating material used | $MoSi_2$ heater<br>1600° C. when casting begins Heating performed during casting No insulating material used | Gas burner preheating<br>800° C. when casting begins Heating not performed during casting Insulating material used | External coil preheating (800° C.)<br>650° C. when casting begins Heating not performed during casting Insulating material used | External coil preheating (1100° C.)<br>850° C. when casting begins Heating not performed during casting Insulating material used |
| a) Time from end of preheating until casting starts | 10 minutes | 10 minutes | 10 minutes | 10 minutes | 10 minutes | 10 minutes |
| b) Time heating is interrupted | 1 minute (or less) | 0 minutes (or less) | 0 minutes (or less) | 10 minutes | 10 minutes | 10 minutes |

TABLE 1-continued

| | Example 1 | Example 2 | Example 2 | Comparative example 1 | Comparative example 2 | Comparative example 3 |
|---|---|---|---|---|---|---|
| Number of uses | 6 heats | 6 heats | 6 heats | 4 heats Casting interrupted due to nozzle blockage | 5 heats Casting interrupted due to nozzle blockage | 5 heats Casting interrupted due to nozzle blockage |
| Ar blowing | No | No | No | 5 liters/minute | 5 liters/minute | No |
| Thickness of adhesion inside nozzle after use | Alumina adhesion 3 mm thick | Alumina adhesion 2 mm thick | Alumina adhesion 1 mm thick | Mixed adhesion of base metal/alumina 15 mm or thicker | Mixed adhesion of base metal/alumina 10 mm or thicker | Mixed adhesion of base metal/alumina 10 mm or thicker |

INDUSTRIAL APPLICABILITY

According to the present invention, the outside surface of the continuous casting nozzle is maintained at 1000° C. or higher by a nozzle heating device. As a result, without depending on the blowing of argon gas which can cause defects, the temperature of the continuous casting nozzle can be raised and maintained without problems such as current leakage or the deterioration of refractory materials occurring, thereby preventing the adhesion of non-metallic oxides and base metal. As a result, blocking of the continuous casting nozzle by adhesion can be prevented, and the number of consecutive continuous casting charges can be increased.

Brief Description of the Reference Symbols

1 Ladle
2 Tundish
3 Mold
4 Long nozzle
5 Submerged nozzle
6, 6A, 6B Nozzle heating device
7 Transformer
8 Control panel
61 Insulating section
62 Carbon heater
62B SiC heater (or $MoSi_2$ heater)
63 Hinge
64 Support arm
65 Conductive wire
66B Wiring
67C, 68C, 69C First, second, third insulating material

The invention claimed is:

1. A continuous casting method in which an outside surface of a continuous casting nozzle which supplies molten metal into a mold while immersed in the molten metal in the mold, is heated to 1000° C. or higher by a nozzle heating device comprising an external heater which performs radiant heating, while the molten metal passes through the continuous casting nozzle, wherein the nozzle heating device has an insulator which surrounds an outside of the continuous casting nozzle while leaving a gap therebetween, and wherein the insulator has the external heater disposed therein and said insulator comprises multiple divided segments.

2. The continuous casting method according to claim 1, wherein the external heater is a carbon heater.

3. The continuous casting method according to claim 1, wherein the external heater is a silicon carbide heater or a molybdenum disilicide heater.

4. The continuous casting method according to claim 1, wherein when beginning to supply the molten metal into the mold, the outside surface of the continuous casting nozzle is preheated by the external heater to 1000° C. or higher.

5. The continuous casting method according to claim 1, wherein when beginning to supply the molten metal into the mold, the outside surface of the continuous casting nozzle is preheated by the heater to 1600° C. or higher.

* * * * *

UNITED STATES PATENT AND TRADEMARK OFFICE

CERTIFICATE OF CORRECTION

PATENT NO. : 8,360,136 B2
APPLICATION NO. : 13/141662
DATED : January 29, 2013
INVENTOR(S) : Taijiro Matsui et al.

It is certified that error appears in the above-identified patent and that said Letters Patent is hereby corrected as shown below:

ON THE TITLE PAGE:

At item (86), change the § 371(c)(1), (2), (4) Date from "Jun. 22, 2001" to --Jun. 22, 2011--.

Signed and Sealed this
Twentieth Day of August, 2013

Teresa Stanek Rea
*Acting Director of the United States Patent and Trademark Office*